US009011160B1

(12) United States Patent
Bendik, Jr.

(10) Patent No.: US 9,011,160 B1
(45) Date of Patent: Apr. 21, 2015

(54) HIGH-CONTRAST SOAP FILM MAGNIFICATION DEVICE

(71) Applicant: Joseph John Bendik, Jr., Escondido, CA (US)

(72) Inventor: Joseph John Bendik, Jr., Escondido, CA (US)

( * ) Notice: Subject to any disclaimer, the term of this patent is extended or adjusted under 35 U.S.C. 154(b) by 77 days.

(21) Appl. No.: 13/937,214

(22) Filed: Jul. 9, 2013

Related U.S. Application Data

(60) Provisional application No. 61/690,996, filed on Jul. 9, 2012.

(51) Int. Cl.
*G09B 23/22* (2006.01)
*A63H 33/28* (2006.01)

(52) U.S. Cl.
CPC ..... *A63H 33/28* (2013.01)

(58) Field of Classification Search
USPC ..... 434/276, 283, 295, 297, 300, 303, 365, 434/366, 367; 359/616; 446/219
See application file for complete search history.

(56) References Cited

U.S. PATENT DOCUMENTS 5,172,270 A * 12/1992 Peiperl ..... 359/617
5,225,934 A * 7/1993 Kroll ..... 359/616
6,254,396 B1 * 7/2001 Stevens ..... 434/276
6,422,705 B1 * 7/2002 Leary ..... 359/616
6,439,944 B1 * 8/2002 La Fata ..... 446/15
7,353,693 B2 * 4/2008 Ueyama ..... 73/53.01
7,747,060 B2 * 6/2010 Sadiq ..... 382/135
7,850,457 B2 * 12/2010 Mouhot et al. ..... 434/370
2004/0105076 A1 * 6/2004 Huber ..... 353/20
2010/0248202 A1 * 9/2010 Thompson et al. ..... 434/276

* cited by examiner

*Primary Examiner* — Kurt Fernstrom
(74) *Attorney, Agent, or Firm* — Integral Patent; Laurence J. Shaw

(57) ABSTRACT

A surfactant film viewing apparatus having a chassis, film wand, and film wand positioning means. The chassis is opaque and has a magnifying lens and a light aperture to allow ambient light into the interior of the chassis. The chassis, with the exception of the light aperture and the magnifying lens, forms an substantially closed surface. The film wand has a hoop suitable for supporting a surfactant film across its span. The apparatus includes a means for positioning of said hoop in said interior of said chassis such that the position of said hoop relative to the magnifying lens is stable but manually adjustable so the surfactant film can be positioned for viewing by said magnifying lens. The apparatus may include a reservoir for the surfactant/water mixture, and the means for positioning may also include a means for dipping the hoop in the surfactant/water mixture. In an alternate embodiment the wand has multiple hoops each of which is capable of supporting a surfactant film, rotation of the wand bringing the surfactant films sequentially into view.

24 Claims, 4 Drawing Sheets

HIGH-CONTRAST SOAP FILM MAGNIFICATION DEVICE

RELATED APPLICATIONS

The present application is a non-provisional patent application based on provisional patent application Ser. No. 61/690,996 filed Jul. 9, 2012 by the same inventor and having the same title.

FIELD OF THE INVENTION

The present invention is related to soap bubble toys. Furthermore, the present invention is related to education toys, and more particularly science education toys. Furthermore, the present invention is related to optical devices, more particularly to magnification devices, and still more particularly to portable magnification devices that utilize ambient light.

BACKGROUND OF THE INVENTION

Soap film toys have a long history and a wide variety of soap film toys have been patented and/or marketed. Typical soap film toys involve blowing soap bubbles and viewing them from afar. However, beautiful, fascinating visual effects appear when soap films are viewed under magnification as per the present invention described in the present specification. Furthermore, the present invention facilitates experimentation with soap film. For instance, the effects of changes in the solution or adding small particles to a soap film can be observed with the device of the present invention.

It is therefore an object of the present invention to provide a bubble toy which allows magnified viewing of surfactant films.

It is another object of the present invention to provide a bubble toy which provides optimized lighting, focus and magnification for magnified viewing of surfactant films, and particularly to heighten color contrasts and optimize the viewing of the colors in surfactant films.

It is another object of the present invention to provide a bubble toy for magnified viewing of surfactant films which facilitates the creation and viewing of a surfactant film.

It is another object of the present invention to provide a bubble toy for the study of the physics of surfactant films, such as the hydrodynamics of flows within surfactant films and the constructive and destructive interference which creates the vibrant colors seen in surfactant films.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE INVENTION

A surfactant film viewing apparatus having a chassis, film wand, and film wand positioning means. The chassis is opaque and has a magnifying lens and a light aperture to allow ambient light into the interior of the chassis. The chassis, with the exception of the light aperture and the magnifying lens, forms a substantially closed surface. The film wand has a hoop suitable for maintaining a surfactant film across its span. The apparatus includes a means for positioning of the hoop in the interior of the chassis so that the position of the hoop relative to the magnifying lens is stable but manually adjustable so the surfactant film can be viewed under magnification by the lens.

A surfactant film viewing apparatus having a chassis, film wand, and film wand positioning means. The chassis is opaque and has a magnifying lens and a light aperture to allow ambient light into the interior of the chassis. The chassis, with the exception of the light aperture and the magnifying lens, forms a substantially closed surface. The film wand has a plurality of hoops each of which is suitable for maintaining a surfactant film across its span. The apparatus includes a means for selecting a surfactant film and positioning the selected surfactant film relative to the magnifying lens so it is stable but manually adjustable so the selected surfactant film can be viewed under magnification by the lens.

BRIEF DESCRIPTION OF THE FIGURES

The accompanying figures, which are incorporated in and form a part of this specification, illustrate embodiments of the invention and, together with the description given above and the detailed description of the preferred embodiments given below, serve to explain the principles of the invention.

DETAILED DESCRIPTION OF THE PREFERRED EMBODIMENTS

Reference will now be made in detail to preferred embodiments of the apparatus and method of the present invention. While the invention will be described in conjunction with the preferred embodiments and the underlying physical principles, it should be understood that these descriptions are not intended to limit the invention to the described embodiments, and the accuracy of the description of the underlying physical principles, and the accuracy of the approximations made in the analysis of the physical principles are also not intended to limit the scope of the invention. On the contrary, the invention is intended to cover alternatives, modifications and equivalents which may be included within the spirit and scope of the invention as defined by the appended Claims and their equivalents.

Figure 1:
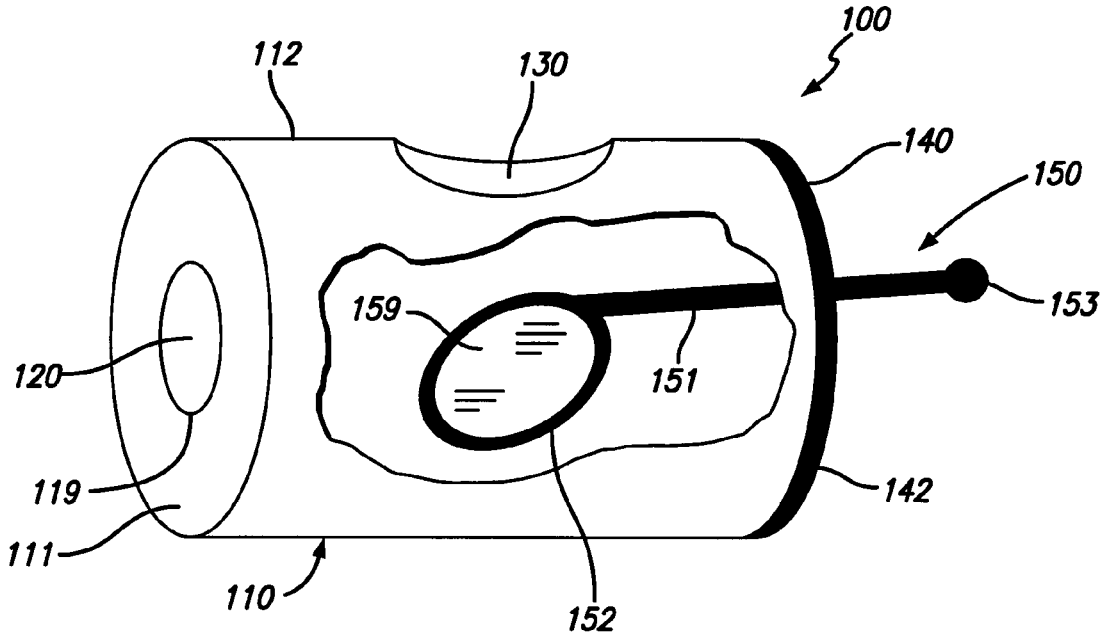
FIG. 1 shows a cut-away view of the soap film magnification device of the present invention.

A cut-away view of the soap film magnification device (100) of the present invention is shown in FIG. 1. (Although the present specification refers to the films viewed by the device of the present invention as soap films, it is noted that soap films are films of a surfactant and water and it should be understood that more generally the device can be used to view surfactant films.) The device (100) has an opaque chassis (110) with a magnifying (i.e., doubly-convex or positive) lens (120) mounted in a circular aperture (119) on a front surface (111) of the chassis (110). On the top of the chassis (110) is an aperture which acts as a light port (130) to allow ambient light to enter the interior of the chassis (110). A removably attachable chassis rear wall (140) of the chassis (110) holds a film wand (150). The film wand (150) has a central positioning shaft (151), a hoop (152) at the end of the shaft (151) located inside the chassis (110), and a gripping bead (153) at the end of the shaft (151) located outside the chassis (110). The film hoop (152) has a thickness and is made of a material which is suitable for maintaining a soap film across its span. The rear wall (140) has a retention hole (141) through which the shaft (151) passes. The retention hole (141) has a diameter large enough to allow the shaft (151) to be slid through and rotated in the retention hole (141) by the application of manual force, and the retention hole (141) has a diameter small enough that when manual force is not applied the position and orientation of the hoop (152) relative to the magnifying lens (120) is stable enough to not inhibit viewing of the film (159) through the lens (120). The chassis (110) in combination with the rear wall (140) forms, with the exception of the light port (130), lens (120) and retention hole (141), essentially a closed surface. The film hoop (152) is substantially circular and according to the present invention the plane of the hoop (152) has an angle relative to the axis of the hoop (152) and the magnifying lens (120) of between 30° and 70°, more preferably between 40° and 60°, and still more preferably roughly 50°. If the plane of the film hoop (152) is too vertical then the hoop (152) must be positioned too precisely relative to the lens (120) to be located within the focal range of the lens (120) to be practical, whereas if the plane of the film hoop (152) is too horizontal then the portion of the film (159) within the focal region of the lens (120) is too small for viewing.

Figure 2:
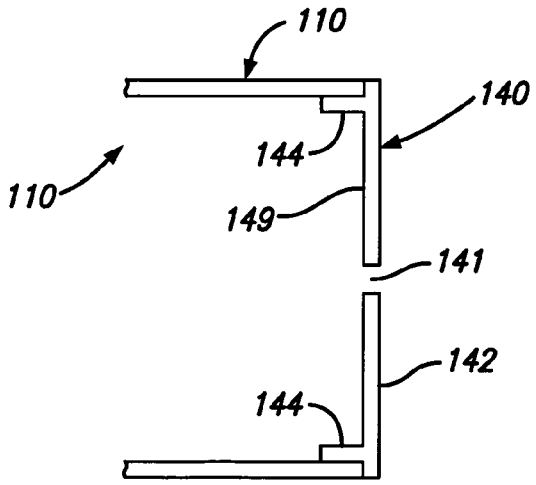
FIG. 2 is a cross-sectional view of the rear end of the chassis and the wand holder.

A cross-sectional view of the rear end of the chassis (110) and the wand holder (140) is shown in FIG. 2. The interior side (149) of the wand holder (140) has a tubular slideable-engagement flange (144) with an exterior diameter roughly that of the interior diameter of the rear of the chassis (110). More particularly, the outer diameter of the slideable-engagement flange (144) has a diameter small enough relative to the inner diameter of the rear of the chassis (110) to allow the wand holder (140) to be rotated and slid in and out of the chassis (110) by applying manual force, and the outer diameter of the slideable-engagement flange (144) has a diameter relative to the inner diameter of the rear of the chassis (110) large enough that when manual force is not applied the position and orientation of the wand holder (140) relative to the chassis (110)—and therefore the hoop (152) relative to the magnifying lens (120)—is stable enough to not inhibit viewing of the film (159). The wand holder (140) may therefore be detached from the chassis (110) so the hoop (152) of the wand (150) may be dipped in a surfactant solution to create a film (159) across the span of the hoop (152). Preferably, the surfactant solution is a soap solution including glycerin which a component which lengthens the lifetime of surfactant films. Then the wand holder (140) may therefore be re-inserted in the chassis (110) so the film (159) spanning the hoop (152) may be viewed. The interior of the chassis (110) is black so as to prevent reflections from appearing on the surfactant film (159) and provide a bright, high-contrast image of the surfactant film (159) when viewed through the lens (120).

Adjustment of the position and orientation of the hoop (152) by adjustment of the position and orientation of the wand (150) relative to the wand holder (140) and/or adjustment of the position and orientation of the wand holder (140) relative to the chassis (110) allows the film (159) to be brought into focus. According to the present invention, the lens (120) is powerful enough to provide good magnification, yet also provides a wide viewing angle and a wide depth of field. According to the present invention, the lens (120) provides between 3× and 15× magnification, more preferably between 5× and 10× magnification, more preferably between 6.5× and 8.5× magnification, and still more preferably roughly 7.5× magnification. Substantially less magnification does not allow the details of the film (159), such as fluid flows in the film (159), to be easily discerned, while greater magnification reduces the visual effect by reducing vividness and contrast and reducing the amount of surface area viewed. According to the present invention, the depth of field is preferably at least 10% of the axial length (i.e., the length along the axis of the shaft (151)) of the hoop (152), more preferably at least 20% of the axial length of the hoop (152), more preferably at least 30% of the axial length of the hoop (152), and still more preferably at least 50% of the axial length of the hoop (152). Furthermore, according to the present invention the in-focus viewing region of the film (159) is preferably at least 2% of the axial projection (i.e., the projection along the axis of the shaft (151)) of the hoop (152), more preferably at least 5% of the axial projection of the hoop (152), more preferably at least 10% of the axial projection of the hoop (152), and still more preferably at least 20% of the transverse projection of the hoop (152). The focal length f and the magnification m are roughly given by the thin lens equations $$1/f=(n-1)(1/R_1+1/R_2),$$

and $$m=f/(f-d),$$

where n is the index of refraction of the lens (120), $R_1$ is the radius of curvature of the front surface of the positive lens (120), $R_2$ is the radius of curvature of the back surface of the positive lens (120), and d is the distance of the film (159) from the lens (120). According to the preferred embodiment of the present invention the lens (120) has a diameter of between 0.5 inches and 2 inches and a focal length of between 0.5 inches and 2.0 inches; more preferably, the lens (120) has a diameter of between 0.75 inches and 1.5 inches and a focal length of between 0.75 inches and 1.5 inches; and still more preferably, the lens (120) has a diameter of roughly 1 inch and a focal length of roughly 1 inch.

According to the preferred embodiment of the present invention, the chassis (110) is substantially cylindrical and has a length from the front (111) to the back surface (140) of roughly 2.5 inches, and a diameter of roughly 1.75 inches. The film magnification device (100) of the present invention is designed such that the bubble film (159) is well illuminated for viewing under ambient light, which may be light from a clear day sky or a cloudy sky or indoor artificial light. The light port (130) is roughly elliptical or rectangular and has a front-to-back length of roughly 1.5 inches and a width of roughly 1 inch. If the light port (130) is considerably smaller, e.g., smaller than 0.5 inches by 0.5 inches, the richness of color and contrast of the viewed film (159) is compromised, and if the light port (130) is considerably larger than 1.5 inches by 1 inch then stray reflections distract from the image of the viewed film (159). Furthermore, if the lightport (130) is considerably larger, then external breezes cause vibrations across the film membrane which disturb the viewing of the film (159). (However, the film (159) can be disturbed on purpose to observe the effects of the disturbances on the film (159) by shaking the chassis (110) or, for instance, waving a hand of the light port (130) to cause a breeze.) Preferably, the ratio of the area of the hoop (152) to the area of the light port (130) is between 3:1 and 1:3, more preferably between 2:1 and 1:2, still more preferably between 1.5:1 and 1:1.5, still more preferably between 1.25:1 and 1:1.25, and still more preferably roughly 1:1. The wand (150) has a total length from the gripping bead (153) to the outside end of the hoop (152) of 3 inches, the gripping bead (153) has a diameter of 0.25 inches, and the diameter of the shaft (151) is roughly 0.625 inches. The above-described characteristics of the lens (120) and the above-described dimensions of the chassis (110) and wand (150) are such that the gripping bead (153) generally extends beyond the rear of the wand holder (140) by less than 2 inches and typically around 1 inch. The slideable-engagement flange (144) has a length of roughly 0.5 inches and a thickness of roughly 0.25 inches.

Figure 3A:
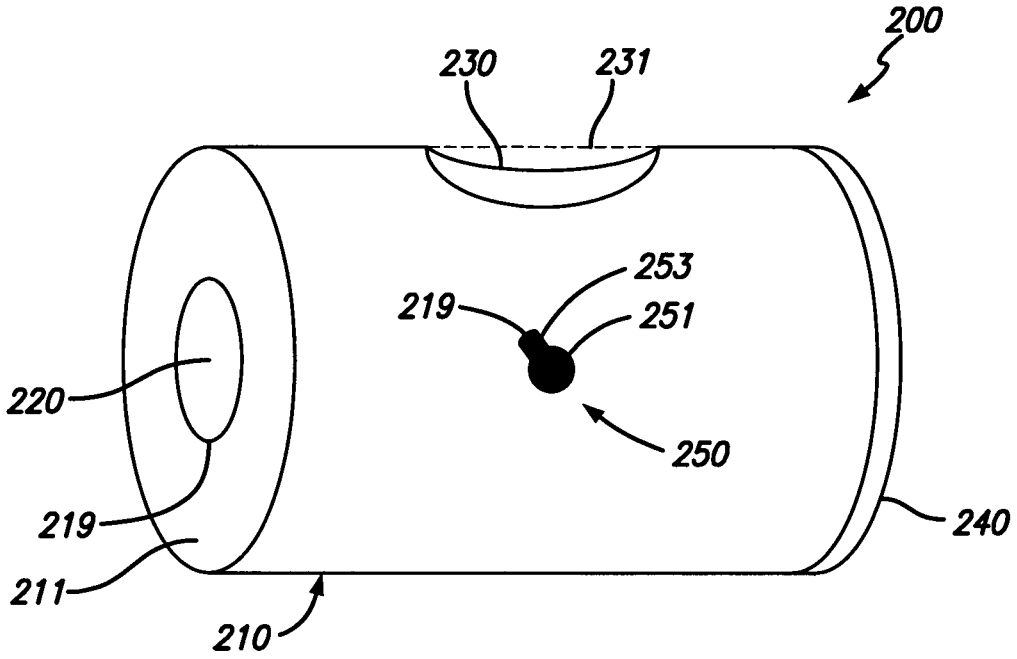
FIG. 3A shows a perspective view of an alternate embodiment of the soap film magnification device of the present invention.
Figure 3B:
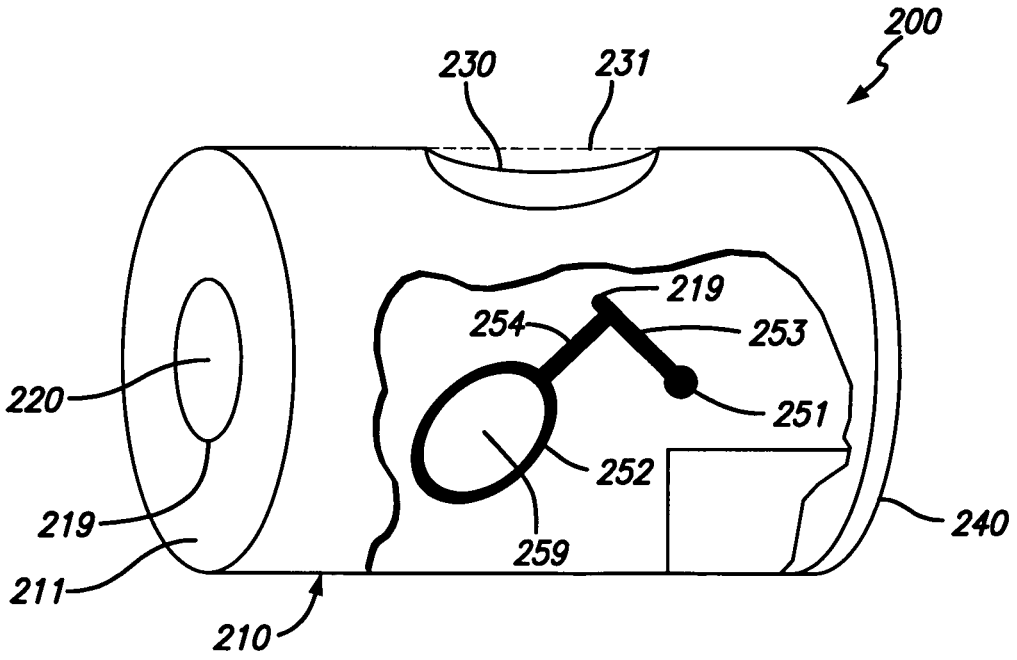
FIG. 3B shows a cut-away view exposing the internal mechanism of the alternate embodiment of the soap film magnification device of FIG. 3A.
Figure 3C:
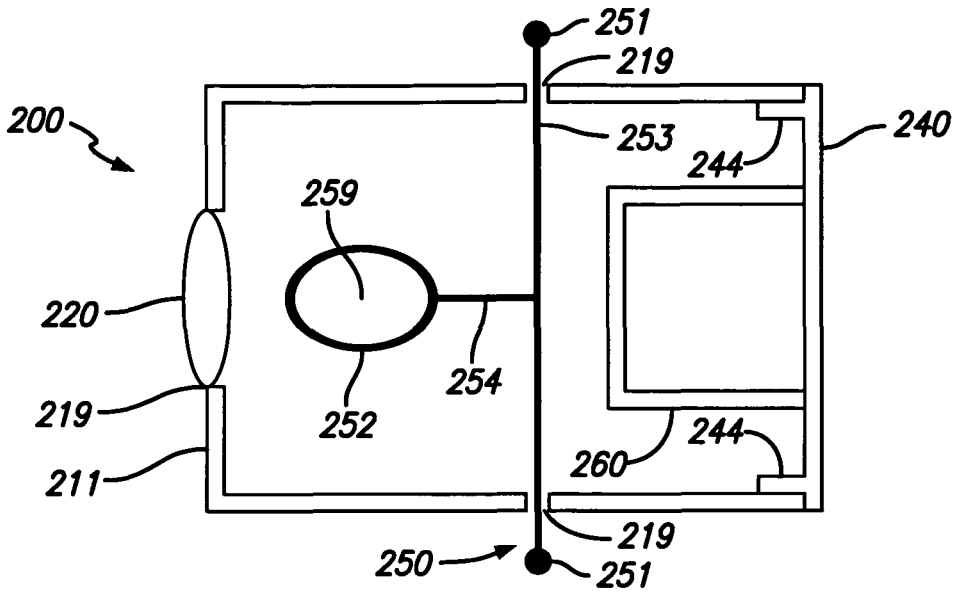
FIG. 3C is a top cut-away view of the bottom half of the soap film magnification device of FIG. 3A showing the internal mechanism with the film hoop in the focal range of the lens.

A perspective view of an alternate embodiment of the soap film magnification device (200) of the present invention is shown in FIG. 3A and a cut-away view is shown in FIG. 3B. The device (200) has a chassis (210) with a doubly-convex (i.e., positive) lens (220) mounted in a circular aperture (219) on a front surface (211) of the chassis (210). The interior of the chassis (210) is black so as to prevent reflections from appearing on the soap film (259) and provide a bright, high-contrast image of the soap film (259) when viewed through the lens (220). On the top of the chassis (210) is an aperture which acts as a light port (230) to allow ambient light to enter the interior of the chassis (210). The light port (230) is covered with a translucent diffuser, such as wax paper, or light filter (231). The diffuser (231) covering the light port (230) is particularly helpful when the light source is very localized, such as light generated from a halogen lamp or LED (light emitting diode). Localized light tends to produce an image of the light source on the viewed film (259). The diffuser (231) also provides the advantage of acting as a wind shield for the surfactant film (259). In windy or drafty environment the wind shielding provided by the diffuser (231) can substantially increase the lifetime of the surfactant film (259).

In this alternate embodiment the film wand (250) has a horizontal, pivotable axle (253) which extends through an axle aperture (219) on each side of the chassis (210). At each end of the axle (253) is a gripping bead (251), extending orthogonally from the center of the axle (253) is a wand arm (254), and at the end of the wand arm (254) is a hoop (252). The film hoop (252) has a thickness and texture and is made of a material suitable for maintaining a soap film across its span. The diameter of the axle (253) is small enough relative to the diameter of the axle aperture (219) to allow the axle (253) to be rotated by applying manual torque to a gripping bead (251), and the diameter of the axle (253) is large enough that when a manual torque is not applied to the gripping beads (251) the axle (253)—and therefore the position of the hoop (252) relative to the magnifying lens (220)—is stable enough to not inhibit viewing of a surfactant film (259) spanning the hoop (252).

Figure 3D:
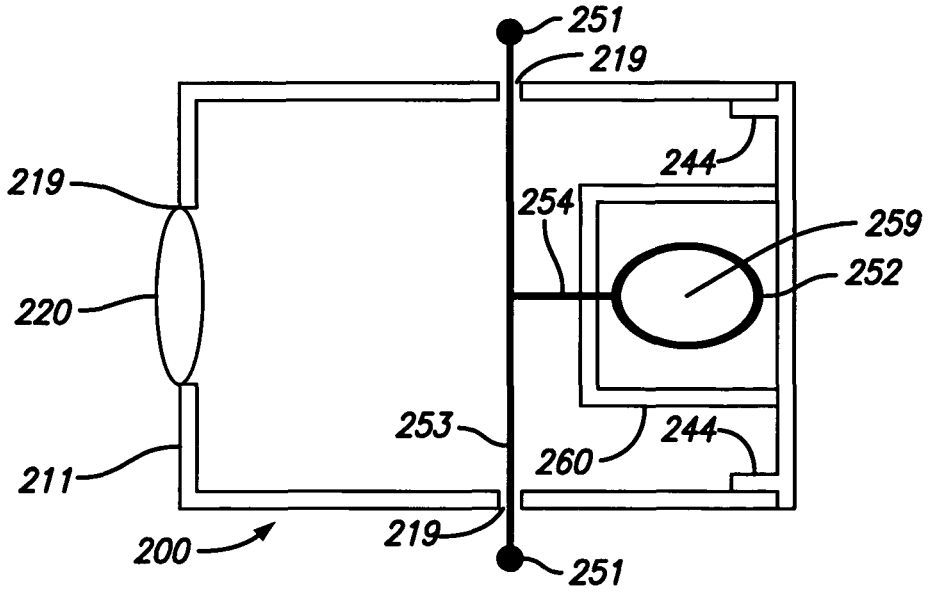
FIG. 3D is a top cut-away view of the bottom half of the soap film magnification device of FIG. 3A showing the internal mechanism with the film hoop in the surfactant solution reservoir.
Figure 3E:
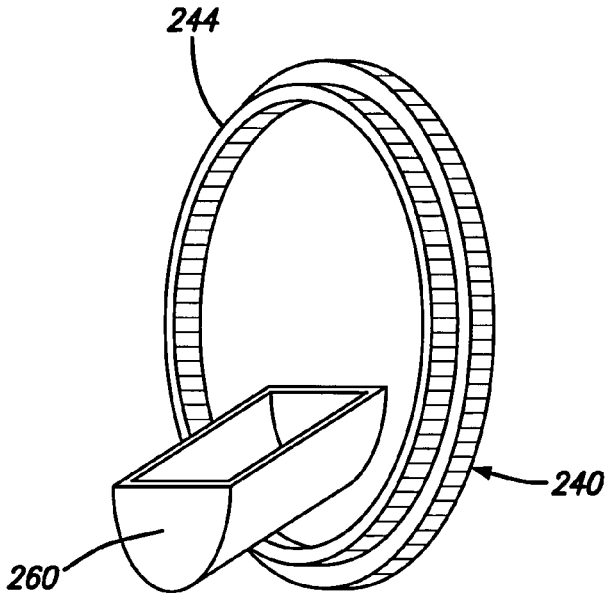
FIG. 3E is a perspective view of the removably attachable rear wall and surfactant reservoir of the alternate embodiment of the soap film magnification device of FIG. 3A.

At the rear end of the chassis (210) is a removable rear wall (240). A perspective view of the rear wall is shown in FIG. 3E. The chassis-interior side of the rear wall (240) has a tubular slideable-engagement flange (244) with an exterior diameter roughly that of the interior diameter of the rear of the chassis (210). More particularly, the outer diameter of the slideable-engagement flange (244) has a diameter small enough relative to the inner diameter of the rear of the chassis (210) to allow the rear wall (240) to inserted into and removed from the chassis (210) by manual force, and the outer diameter of the slideable-engagement flange (244) has a diameter relative to the inner diameter of the rear of the chassis (210) large enough that when manual force is not applied then the position of the rear wall (240) relative to the chassis (210)—and therefore the position of the hoop (252) relative to the magnifying lens (220)—is stable enough to not inhibit viewing of the film (259).

Extending from the rear wall (240) on the chassis-interior side of the rear wall (240) is a surfactant reservoir (260) which may be filled with a surfactant when the rear wall (240) is separated from the chassis (210). When the rear wall (240) is inserted in the chassis (210), as shown in FIGS. 3A, 3B, the axle (253) may be rotated so that the hoop (252) is submerged in the surfactant in the surfactant reservoir (260) as shown in FIG. 3D, and then the axle (253) may be rotated to raise the hoop (252) out of the reservoir (260) so that a surfactant film (259) will span the hoop (252).

Adjustment of the position of the hoop (252) by rotation of the wand (250) allows the film (259) to be brought into the focal region of the lens (220) so the film (259) spanning the hoop (252) may be viewed under magnification. According to the present invention, the lens (220) is powerful enough to provide good magnification, yet also provides a wide viewing angle and a wide depth of field. The characteristics of the lens of this alternate embodiment are substantially the same as those described above for the first preferred embodiment.

According to the preferred embodiment of the present invention, the chassis (210) is substantially cylindrical and has a length from the front (211) to the back surface (240) of roughly 2.5 inches, and a diameter of roughly 1.75 inches. The film magnification device (200) of the present invention is designed such that the bubble film (259) is well illuminated for viewing under ambient light which may be light from a clear day sky or a cloudy sky or indoor artificial light. The light port (230) is roughly elliptical and has a front-to-back length of roughly 1.5 inches and a width of roughly 1 inch. As described above, if the light port (230) is considerably smaller, e.g., smaller than 0.5 inches by 0.5 inches, the richness of color and contrast of the viewed film (259) is compromised, and if the light port (230) is considerably larger than 1.5 inches by 1 inch then stray reflections distract from the image of the viewed film (259). The wand axle (253) has a length of roughly 2.25 inches, the gripping beads (251) have a diameter of roughly 0.25 inches, and the diameter of the axle (253) and the aperture (219) are roughly 0.625 inches. The slideable-engagement flange (244) has a length of roughly 0.5 inches and a thickness of roughly 0.25 inches.

Figure 4A:
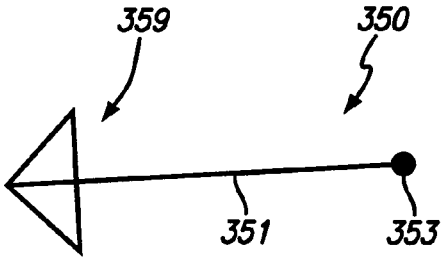
FIG. 4A is a side view of an alternate embodiment of the wand which supports multiple surfactant films.
Figure 4B:
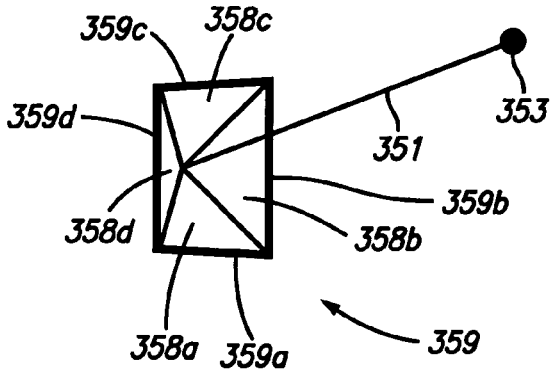
FIG. 4B is a perspective view of an alternate embodiment of the wand of FIG. 4A.

In another preferred embodiment, the wand (350), as shown in FIGS. 4A and 4B, can support a number of surfactant films (358*a*), (358*b*), (358*c*), and (358*d*). The film wand (350) has a central positioning shaft (351), a gripping bead (353) at an end of the shaft (351), and four triangular "hoops" (359*a*), (359*b*), (359*c*), and (359*d*) which abut and form a pyramid with the apex of the pyramid at the other end of the shaft (351). The four triangular "hoops" (359*a*), (359*b*), (359*c*), and (359*d*) have a thickness and are made of a material which is suitable for maintaining surfactant films across their spans. When the longitudinal axis of the positioning shaft (351) is off-axis from the central axis of the lens, the surfactant films (358*a*), (358*b*), (358*c*), and (358*d*) can be sequentially brought into view by rotation of the wand (350) about the longitudinal axis of the positioning shaft (351). (The surfactant films (358*a*), (358*b*), (358*c*), and (358*d*) will be referred to generically with reference numeral 358.) This embodiment of the wand (350) provides the advantage that if one surfactant film (358) breaks before the others, other surfactant films (358) can be rotated into view.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. For instance, other means of magnification, such as a Fresnel lens, multiple lenses, a plastic lens or a wide angle lens, may be used; the chassis may be otherwise shaped; the light port may be otherwise located or otherwise shaped; the soap film may be lighted with an internal light source, such as an incandescent bulb; the gripping beads may be otherwise shaped or there may not be a gripping bead; the hoop may be otherwise shaped; the angle of the hoop relative to the axis of the shaft may be adjustable; the soap film may be viewed with the eye or with a camera, such as a ccd (charge-coupled device) camera; components, such as the chassis and wand holder, may be made of a variety of materials, such as plastic, wood, metal, ceramic, etc.; surfactants other than soap may be used to produce the film to be viewed; the dimensions of the device may be scaled up or down, e.g., the dimensions of the device may be scaled up by a factor of two or three or more, or scaled down by a factor of 50% or less; etc.

Accordingly, it is intended that the scope of the invention be determined not by the embodiments illustrated or the physical analyses motivating the illustrated embodiments, but rather by the appended claims and their legal equivalents.

What is claimed is:

1. A surfactant film viewing apparatus, comprising:

an opaque chassis having a light aperture to allow ambient light into the interior of said chassis and a lens aperture into which is mounted a magnifying lens, said chassis, with the exception of said light aperture and said lens aperture, being a substantially closed surface;

a film wand having a hoop for supporting a surfactant film across its span; and a means for positioning of said hoop in said interior of said chassis such that a position of said hoop relative to said magnifying lens is stable but adjustable by application of manual force so said surfactant film can be positioned for viewing under magnification by said magnifying lens.

2. The surfactant film viewing apparatus of claim 1 wherein said chassis includes a removably attachable rear chassis wall, and said means for positioning includes a positioning shaft attached to said hoop and a retention hole in said rear chassis wall in which said positioning shaft is held.

3. The surfactant film viewing apparatus of claim 2 wherein said rear chassis wall is opposite said magnifying lens.

4. The surfactant film viewing apparatus of claim 1 wherein said hoop is substantially planar and at an angle of 30° to 70° from an axis between the center of said hoop and the center of said magnifying lens.

5. The surfactant film viewing apparatus of claim 1 wherein said hoop is substantially planar and at an angle of 40° to 60° from an axis between the center of said hoop and the center of said magnifying lens.

6. The surfactant film viewing apparatus of claim 1 further including a reservoir in said interior of said chassis for holding a surfactant/water mixture, and said means for positioning includes means for dipping said hoop in said surfactant/water mixture in said reservoir.

7. The surfactant film viewing apparatus of claim 1 wherein said magnifying lens provides between 5× and 10× magnification.

8. The surfactant film viewing apparatus of claim 1 wherein said magnifying lens provides between 6.5× and 8.5× magnification.

9. The surfactant film viewing apparatus of claim 1 wherein said light aperture is covered by a translucent light diffuser.

10. The surfactant film viewing apparatus of claim 1 wherein said light aperture is covered by a wind shield.

11. The surfactant film viewing apparatus of claim 1 wherein a depth of field of said magnifying lens is at least 10% of a depth of said hoop along an axis between said hoop and said magnifying lens.

12. The surfactant film viewing apparatus of claim 1 wherein a depth of field of said magnifying lens is at least 20% of a depth of said hoop along an axis between said hoop and said magnifying lens.

13. The surfactant film viewing apparatus of claim 1 wherein a depth of field of said magnifying lens is at least 30% of a depth of said hoop along an axis between said hoop and said magnifying lens.

14. The surfactant film viewing apparatus of claim 1 wherein a depth of field of said magnifying lens is at least 50% of a depth of said hoop along an axis between said hoop and said magnifying lens.

15. The surfactant film viewing apparatus of claim 1 wherein an in-focus viewing region of said surfactant film is at least 2% of a range of motion of said hoop along an axis between said hoop and said magnifying lens.

16. The surfactant film viewing apparatus of claim 1 wherein an in-focus viewing region of said surfactant film is at least 5% of a range of motion of said hoop along an axis between said hoop and said magnifying lens.

17. The surfactant film viewing apparatus of claim 1 wherein an in-focus viewing region of said surfactant film is at least 10% of a range of motion of said hoop along an axis between said hoop and said magnifying lens.

18. The surfactant film viewing apparatus of claim 1 wherein an in-focus viewing region of said surfactant film is at least 20% of a range of motion of said hoop along an axis between said hoop and said magnifying lens.

19. The surfactant film viewing apparatus of claim 1 wherein a ratio of an area of said hoop to an area of said light aperture is between 2:1 and 1:2.

20. The surfactant film viewing apparatus of claim 1 wherein a ratio of an area of said hoop to an area of said light aperture is between 1.5:1 and 1:1.5.

21. The surfactant film viewing apparatus of claim 1 wherein a ratio of an area of said hoop to an area of said light aperture is between 1.25:1 and 1:1.25.

22. A surfactant film viewing apparatus, comprising:

an opaque chassis having a light aperture to allow ambient light into the interior of said chassis and a lens aperture into which is mounted a magnifying lens, said chassis, with the exception of said light aperture and said lens aperture, being a substantially closed surface;

a film wand having a plurality of hoops, each of said hoops for supporting a surfactant film across its span; and a means for positioning of said wand in said interior of said chassis for selecting one of said surfactant films for viewing by said magnifying lens and positioning the selected said one of said surfactant films relative to said magnifying lens, said positioning being stable but adjustable by application of manual force so the selected said one of said surfactant films can be positioned for viewing under magnification by said magnifying lens.

23. The surfactant film viewing apparatus of claim 22 wherein said plurality of hoops abut.

24. The surfactant film viewing apparatus of claim 23 wherein said plurality of hoops form a pyramid.

* * * * *